US009970156B2

(12) United States Patent
Song et al.

(10) Patent No.: US 9,970,156 B2
(45) Date of Patent: May 15, 2018

(54) STEEL CORD FOR RUBBER REINFORCEMENT AND METHOD FOR MANUFACTURING THE SAME

(71) Applicant: Hongduk Industrial Co. Ltd., Gyeongsangbuk-do (KR)

(72) Inventors: Seong Hun Song, Gyeongsangbuk-do (KR); Jae Duk Im, Gyeongsangbuk-do (KR); Sung Young Lim, Busan (KR)

(73) Assignee: Hongduk Industrial Co., Ltd., Gyeongsangbuk-do (KR)

( * ) Notice: Subject to any disclaimer, the term of this patent is extended or adjusted under 35 U.S.C. 154(b) by 350 days.

(21) Appl. No.: 14/798,638

(22) Filed: Jul. 14, 2015

(65) Prior Publication Data

US 2016/0130750 A1 May 12, 2016

(30) Foreign Application Priority Data

Nov. 10, 2014 (KR) ..... 10-2014-0155117

(51) Int. Cl.
*D07B 1/06* (2006.01)
*C23C 18/16* (2006.01)
(Continued)

(52) U.S. Cl.
CPC ..... *D07B 1/0606* (2013.01); *B21C 1/003* (2013.01); *B21C 1/04* (2013.01); *B21C 3/02* (2013.01);
(Continued)

(58) Field of Classification Search
CPC ..... D07B 2205/3089; D07B 2801/18; D07B 1/0606; D07B 1/0666; D07B 2201/2011;
(Continued)

(56) References Cited

U.S. PATENT DOCUMENTS 4,978,586 A * 12/1990 Chambaere ..... C23C 14/086 428/621
6,372,697 B1 * 4/2002 Lorentz ..... B60C 9/0007 508/198

FOREIGN PATENT DOCUMENTS

GB 2076320 A * 12/1981 ..... B21C 37/042
JP 2003171887 6/2003
(Continued)

OTHER PUBLICATIONS

JP 4031639 B2, Jan. 2008, Machine translation.*
KR 20010003864 A, Jan. 2001, Derwent Ab.*
KR 20020078168 A, Oct. 2002, Derwent Ab.*

*Primary Examiner* — Satya Sastri
(74) *Attorney, Agent, or Firm* — DeLio, Peterson & Curcio, LLC; Peter W. Peterson

(57) ABSTRACT

The present invention relates to a steel cord for rubber reinforcement. In the steel cord of the present invention, cobalt is contained by 0.001 ppm to 0.1 ppm within a 4 nm top-surface of the brass-plated steel wire. A method of manufacturing the steel cord includes: providing a brass-plated steel wire; mixing a cobalt compound in a wet lubricant filled in a wet drawing bath provided with a plurality of drawing dies between one pair of multi-stage drawing cones such that the concentration of the cobalt compound becomes 0.1 ppm to 100 ppm; and causing the cobalt to be contained by 0.001 ppm to 0.1 ppm within a 4 nm top-surface of the brass-plated steel wire after the brass-plated steel wire passes through a final die by causing the cobalt to be attached to a surface of the brass-plated steel wire and alloyed with a brass layer while the brass-plated steel wire is passing through the drawing cones and the drawing dies to be subjected to multi-stage drawing.

6 Claims, 1 Drawing Sheet

(51) Int. Cl.

| | |
|---|---|
| ***B21C 9/02*** | (2006.01) |
| ***B21C 1/00*** | (2006.01) |
| ***B21C 1/04*** | (2006.01) |
| ***B21C 3/02*** | (2006.01) |
| ***C10M 139/00*** | (2006.01) |
| ***C10M 129/24*** | (2006.01) |
| ***C10M 129/40*** | (2006.01) |
| ***C10M 129/46*** | (2006.01) |
| ***C10M 129/58*** | (2006.01) |
| ***C10M 129/62*** | (2006.01) |

(52) U.S. Cl.

CPC ..... *B21C 9/02* (2013.01); *C10M 129/24* (2013.01); *C10M 129/40* (2013.01); *C10M 129/46* (2013.01); *C10M 129/58* (2013.01); *C10M 129/62* (2013.01); *C10M 139/00* (2013.01); *C23C 18/1637* (2013.01); *D07B 1/0666* (2013.01); *C10N 2210/08* (2013.01); *C10N 2230/06* (2013.01); *C10N 2240/402* (2013.01); *C10N 2240/408* (2013.01); *D07B 2205/3089* (2013.01)

(58) Field of Classification Search

CPC ..... D07B 2201/2013; C01B 13/363; C01F 7/005; C01G 9/00; C01P 2002/08; C01P 2002/22; B21C 1/003; B21C 1/04; B21C 3/02; B21C 9/02; C10M 129/24; C10M 129/40; C10M 129/46; C10M 129/58; C10M 129/62; C10M 139/00; C10N 2210/08; C10N 2240/402; C10N 2240/408; C23C 18/1637

See application file for complete search history.

(56) References Cited

FOREIGN PATENT DOCUMENTS

| | | | | | |
|---|---|---|---|---|---|
| JP | 4031639 | B2 | * | 1/2008 | ..... D07B 1/0666 |
| KR | 19930013214 | | | 7/1993 | |
| KR | 19950000929 | | | 8/1995 | |
| KR | 20000074219 | | | 12/2000 | |
| KR | 20010003864 | | | 1/2001 | |
| KR | 20010003864 | A | * | 1/2001 | ..... D07B 1/0666 |
| KR | 20020078168 | A | * | 10/2002 | ..... D07B 1/0666 |

* cited by examiner

[FIG. 1]
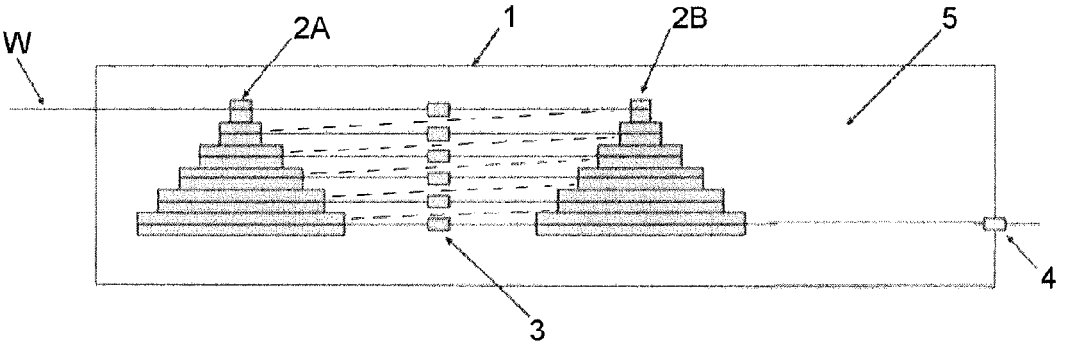

STEEL CORD FOR RUBBER REINFORCEMENT AND METHOD FOR MANUFACTURING THE SAME

BACKGROUND OF THE INVENTION

1. Field of the Invention

The present invention relates to a steel cord for rubber reinforcement, which is buried in a rubber product, such as a tire, and more particularly, to a steel cord for rubber reinforcement and a method for manufacturing the same, in which an infinitesimal amount of a cobalt compound is added to a wet lubricant at the time of drawing a brass-plated steel wire that forms the steel cord so that brass and cobalt are alloyed with each other in the top-surface of the brass plating layer, thereby achieving an aging adhesion improvement of the steel cord.

2. Description of Prior Art

A steel cord, buried in a vehicle tire to be used for rubber reinforcement, includes a brass plating layer fainted on the surface thereof so as to improve adhesion with the tire rubber and drawing machinability in a steel wire manufacturing process. The steel wire including the brass plating layer formed in this way is buried in a tire as a single body or in a stranded state where multiple steel wires are stranded, so as to reinforce the tire.

Meanwhile, the adhesive strength between the brass-plated steel wire and the tire rubber is gradually reduced as time passes as compared to the adhesive strength at the early stage of vulcanization due to various factors. The representative adhesive strength reducing factors may include intensive heat and moisture situations suffered by the tire while a vehicle is traveling.

First, descriptions will be made on the heat according to the traveling of the vehicle. As the temperature of tires rises while the vehicle travels at a high speed, sulfur, which did not fully undergo vulcanization at the early stage of vulcanization, continuously causes vulcanization and increases hardness of the rubber so that the rubber itself losses elasticity. Then, fatigue degradation is caused by the impact continuously applied from the road and the weight of the vehicle. In addition, the heat generated during the traveling causes an adhesive reaction between the brass and the rubber so that a copper sulfide layer produced at the early state of vulcanization is continuously produced. The copper sulfide layer grown over a normal thickness is easily fractured from the brass layer by the impact applied to the tire, which causes the reduction of adhesive strength.

Next, descriptions will be made on the moisture. When the tire rubber is damaged, water permeates into the tire rubber through the damaged portion so that chemical breakdown and corrosion occur around the steel cord, which causes a sharp reduction of the initial adhesive strength produced at the time of vulcanization.

Accordingly, in order to extend the life span of the tire, providing high heat-resistant adhesion and water-resistant adhesion is considered as important as maintaining the high initial adhesive strength between the plated steel wires and the tire rubber.

As a measure for improving the heat-resistant (corrosion-resistant) and water-resistant adhesion as important quality characteristics requested for the steel cord, there is known a method of forming a plating layer of a ternary alloy or a quaternary alloy by adding other elements to the brass that forms the surface of the steel wire.

For example, Korean Patent Laid-Open Publication Nos. 2000-0074219 and 1995-0000929 disclose a method of obtaining a plating layer formed of a ternary alloy of Cu—Zn—Co by sequentially plating copper, zinc, and cobalt on the surface of a steel wire, and performing a diffusion step. However, such a method requires separate additional steps to plate and diffuse a third element, cobalt, in addition to the brass plating layer forming step, which unavoidably causes the complication of the manufacturing process and the increase of manufacturing costs.

Meanwhile, for example, Korean Patent Laid-Open Publication No. 1993-0013214 and Japanese Patent Laid-Open Publication No. 2003-171887 disclose a technique for improving the corrosion-resistant and water-resistant adhesive strength of a steel cord merely by coating a cobalt compound on a steel wire surface during a drawing or elongation step of a brass-plated steel wire. However, the cobalt compound merely coated on the surface of the steel cord (plated steel wire) is not strongly bonded with the brass layer, thereby merely suppressing the reduction of the water-resistant adhesion of the brass in relation to only the rubber, rather than having an effect on the adhesion interface layer of the brass and the rubber so that the practical effect is not so high.

For example, Korean Patent Laid-Open Publication Nos. 2001-0003864 and 2008-0072700 disclose a method for improving corrosion-resistant and water-resistant adhesion by providing a separate lubricating bath, in which a cobalt compound is dissolved, outside the outlet of a drawing bath at the time of drawing so that the cobalt compound, coated on the surface of the brass-plated steel wire passing through the lubricating path, forms a ternary alloy of brass-cobalt on the surface while passing through the final die. With the above-mentioned method, it is expected that the above-mentioned effect may be achieved at the time of small-scale production. However, as the production increases, that is, as the operating time of the lubricating bath increases, a frictional force between the dies in the lubricating bath and the steel wire increases, the temperature of the lubricating liquid in the lubricant rises due to the high-temperature heat generated from the dies, and a sharp deterioration of wire drawability is caused so that, for example, serious surface cutting or snapping may occur in the steel wire after the steel wire is drawn.

In addition, the content of the cobalt component bonded to the surface of the steel cord according to the above-mentioned method has a high concentration of several ppm or more. The high concentration of cobalt does not cause a practical problem in small-scale production. In mass production, however, due to the friction between the cobalt component used as an adhesive material at the time of sintering nibs within the dies used for drawing and the cobalt contained in the lubricant, the fracturing of dies increases and fragments chipped off from the nips of the dies may be caught in the inlet of the subsequent dies and scratch the surfaces of the drawn wires. Then, in the stranding step performed thereafter to strand the steel wires, when torsional stresses are applied to the steel wires by the stranding of the steel wires, snapping frequently occurs at the surface-scratched portions, which causes a reduction in productivity.

As no clear solution for the problems described above has been proposed to date in the related art, cobalt is included in the rubber rather than being bonded to the surface of the steel cord. That is, adhesive rubber in all the tires includes a cobalt component additive. Since a sufficient amount of cobalt is included in the adhesive rubber, the aging adhesive strength improvement effect by the cobalt component existing on the surface of the steel cord at a high concentration of a predetermined level or more is lower than might be expected.

In addition, when the cobalt component exists on the surface of the steel cord at a high concentration, the cobalt is eluted as a heavy metal when the tires, of which the lives have been ended, are disposed of, and thus, environmental pollution is caused. Thus, when the cobalt component is used for improving adhesion between the steel cord and rubber, it is necessary to apply the cobalt component within a minimal and optimal content range that is capable of removing the above-mentioned problems while answering the purpose of using the cobalt component.

SUMMARY OF THE INVENTION

The present invention has been made in consideration of the problems described above, and an object of the present invention is to provide a steel cord for rubber reinforcement, which is formed of plated steel wires, in which cobalt is attached to the plated steel wires within a content range that is capable of contributing to improving an adhesive strength with rubber, in particular, an aging adhesive strength with rubber as much as possible, removing a quality characteristic impediment factor in a manufacturing process including a drawing step, and minimizing an environmental problem when a final product is disposed of after use.

Another object of the present invention is to provide a method for manufacturing the above-mentioned steel cord for rubber reinforcement, in which, in the process of drawing a brass-plated steel wire in a wet drawing bath, a cobalt compound is mixed with the wet lubricant within the drawing bath within a minimal amount range required for an adhesion improvement so that a ternary alloy layer of brass-cobalt is foamed on the surface of the steel wire without deteriorating drawing machinability during the drawing over multiple stages.

The above-mentioned objects of the present invention are achieved by a steel cord for rubber reinforcement comprising one or more brass-plated steel wires, in which cobalt of 0.001 to 0.1 ppm is contained in within a 4 nm top-surface depth of the brass-plated steel wire.

That is, the steel wire that forms the steel cord according to the present invention has a plating layer of a ternary alloy of Cu—Z—-Co in which an infinitesimal but measurable amount of cobalt is added as a third element. The ternary alloy is formed within a 4 nm top-surface depth from the surface of the plating layer on the steel wire. When the cobalt exists in a depth exceeding 4 nm from the surface of the steel wire, an adhesion improvement effect in relation to the adhesive rubber existing outside the surface of the steel wire cannot be expected.

When the content of the cobalt existing within the 4 nm top-surface of the steel wire for the steel cord according to the present invention is less than 0.001 ppm, the rubber adhesion improvement effect desired to be obtained through the alloying of the cobalt can be hardly expected so that there is no corrosion-resistant and water-resistant adhesive strength improvement effect. On the contrary, when the attached amount of cobalt exceeds 0.1 ppm, drawability is degraded in the process of wet drawing of the brass-plated steel wire, and no corrosion-resistant and water-resistant improvement effect will be exhibited any more.

The steel cord of the present invention may be formed by one steel wire having the Cu—Zn—Co alloy layer with the above-mentioned composition, or two or more such steel wires that are stranded with each other.

According to the present invention, there is provided a method of manufacturing a steel cord for rubber reinforcement. The method includes: providing a brass-plated steel wire; mixing a cobalt compound in a wet lubricant filled in a wet drawing bath provided with a plurality of drawing dies between one pair of multi-stage drawing cones such that the concentration of the cobalt compound becomes 0.1 ppm to 100 ppm; and causing the cobalt to be contained by 0.001 ppm to 0.1 ppm within a 4 nm top-surface of the brass-plated steel wire after the brass-plated steel wire passes through a final die by causing the cobalt to be attached to a surface of the brass-plated steel wire and alloyed with a brass layer while the brass-plated steel wire is going through the drawing cones and the drawing dies to be subjected to multi-stage drawing.

In the present invention, in the step of providing the brass-plated steel wire, the surface of the plated steel wire is cleaned using an acid. Then, copper is plated on the surface first, and then zinc is plated on the copper. Subsequently, the steel wire is subjected to a heat treatment, in which the steel wire passes through a flow diffusion furnace of 450° C. to 600° C., so that thermal diffusion is generated between the zinc layer of the surface and the copper layer below the zinc layer and thus, a brass-plated steel wire is obtained.

FIG. 1 illustrates a wet drawing bath in which drawing of the brass-plated steel wire is performed. FIG. 1 is a schematic sectional view illustrating a wet drawing bath for use in a method of the present invention. As illustrated, within the wet drawing bath 1, one pair of drawing cones 2A and 2B are positioned with a space therebetween, in which each drawing cone includes a plurality of concentric discs forming multiple stages. Between the drawing cones 2A and 2B, a plurality of dies 3 are installed. Thus, a brass-plated steel wire W introduced into the wet drawing bath from the outside sequentially passes the respective stages of the two drawing cones 2A and 2B and then get out of the wet drawing bath to the outside through an outlet side die 4 that is positioned at the outlet side of the wet drawing bath.

At this time, the inside of the wet drawing bath 1 is filled with wet lubricant 5, and one die 3 is installed on each route of the brass-plated steel wire W between each pair of corresponding stages of the drawing cones 2A and 2B. Thus, while passing through respective stages of the drawing cones, the brass-plated steel wire W passes through the dies 3 and the final die 4 so that the brass-plated steel wire W is drawn to gradually reduce the diameter of the brass-plated steel wire W.

The dies of the wet drawing bath 1 are formed of, for example, natural diamond, tungsten carbide, or artificial diamond, approach angles of the dies are in a range of 7° to 11°, and a bearing length of the dies is about 0.2 D to 1.0 D. For example, when the diameter of the plated steel wire before the drawing is 1.70 nm and the final diameter of the plated steel wire after the drawing is 0.30 mm, about 25 dies are used.

The wet lubricant filled in the wet drawing bath is classified into an emulsion type or a dispersion type. The emulsion type lubricant is composed of, for example, a liquid fatty acid, an amine-based additive, a wax, a surfactant, and an extreme pressure additive, and the dispersion type lubricant is composed of for example, a solid wax, a fatty acid, an amine-based additive, a dispersing agent, and an extreme pressure additive.

Meanwhile, as for a cobalt compound added to the wet lubricant in the method of the present invention, for example, cobalt boroacylate, cobalt naphthenate, cobalt stearate, cobalt neodecanoate, cobalt borocarboxylate, cobalt acetyl acetate, or cobalt abietate may be used.

The steel cord for rubber reinforcement according to the present invention exhibits an improved adhesive strength, in particular, an improved aging adhesive strength with rubber by an infinitesimal amount of cobalt existing in the top-surface of the alloy layer of the steel wire that forms the cord and the improved adhesive strength or aging adhesive strength is considerably higher than that obtained by a steel cord containing a high concentration of cobalt coated or alloyed by an existing method. Further, with the steel cord for rubber reinforcement according to the present invention, material costs can be reduced and environmental pollution can be suppressed.

In the method of manufacturing a steel cord for rubber reinforcement according to the present invention, since a cobalt component is alloyed to the surface of a brass-plated steel wire through automatic attachment and compression during continuous drawing using an existing drawing process without adding a separate plating step, the adhesion between the plated steel wire and rubber can be improved without causing degradation of drawing machinability of the plated steel wire.

BRIEF DESCRIPTION OF THE DRAWINGS

The above and other objects, features and advantages of the present invention will be more apparent from the following detailed description taken in conjunction with the accompanying drawings, in which:

FIG. 1 is a schematic sectional view illustrating a wet drawing bath for use in a method of the present invention.

DETAILED DESCRIPTION OF THE EXEMPLARY EMBODIMENTS

The manufacturing method of the present invention including the above-described objects and technical features of the present invention may be fully understood through the following embodiments. The present embodiment is included in desirable examples provided for understanding of the present invention, and the protection scope of the present invention is not limited or restricted by the embodiment.

First a brass-plated steel wire with a wire diameter of 1.70 mm was prepared. The brass plating layer on the brass-plated steel wire was composed of 64 wt % copper and 36 wt % zinc. In order to allow a structure, hardened after the drawing to the above-mentioned wire diameter, to be drawn again, a heat treatment step and a patenting step were performed, and thus, the structure was transformed into a 100% pearlite structure. During the step of forming the plating layer of the steel wire, a current density of a copper bath and a zinc bath was adjusted so that the attachment amount of the plating layer became 4.0 g/kg to 5.0 g/kg.

Next, the temperature of the lubricant solution within a wet drawing bath where the drawing is to be performed on the brass-plated steel wire was maintained in a range of 40° C. to 50° C., the concentration of the wet lubricant component in the lubricant solution was maintained in a range of 6% to 9%, and a pH of the lubricant solution was maintained in a range of 6 to 9. In addition, the concentration of the cobalt compound added to the lubricant solution was set to 0.1 ppm to 100 ppm.

In the wet drawing bath as described above, the brass-plated steel wire was wired to sequentially pass one pair of drawing cones and dies placed between respective stages of the drawing cones, and thus the brass-plated steel wire was subjected to multi-stage drawing. During the multi-stage drawing, the cobalt dissolved in the lubricant liquid within the drawing bath was coated and pressed on the surface of the brass-plated steel wire, and thus, a ternary alloy of brass-cobalt was formed.

The wire diameter of the final plated steel wire drawn while passing through the wet drawing bath was 0.30 mm.

The plated steel wires subjected to the drawing step were stranded with each other in a wire strander to manufacture steel cord specimens of a 1×2 structure.

First, a measurement was performed to as to check the coated amount of the cobalt included in the plating layers of the specimens. The concentration of cobalt on a steel cord obtained through a conventional method, in which the cobalt is bonded to the surface of a steel cord through an existing plating process or through drawing performed by placing separate independent baths inside and outside a wet drawing bath, is considerably higher than the concentration attached to the steel cord of the present invention. Thus, when the steel cord obtained through the conventional method is analyzed using conventional wet analysis equipment, ICP-AES (Inductively Coupled Plasma-Atomic Emission Spectroscopy), or dry analysis equipment, EDX (Energy Dispersive X-ray), AES (Auger Electron Spectroscopy), or XPS (X-ray Photoelectron Spectroscopy), cobalt is detected in a concentration of several ppm or more or 0.01 to several atomic %. Whereas, since the content of cobalt in the steel cord of the present invention was too small, it was difficult to detect cobalt through the conventional methods using the equipment described above.

Meanwhile, when analysis is performed using the ratio of the amount of a specimen and the amount of solution (testing material 5 g: acidic solution 20 ml), i.e. the C value (g/ml) (the amount of testing material (g)/the amount of acidic solution (ml)) in the step of dissolving the specimen using the ICP-AES equipment, the cobalt concentration detected at the C value of 0.25 g/ml cobalt is several ppm or more in the concentration range of cobalt contained in the cobalt-containing plating layer formed on the steel cord by the conventional method. However, the cobalt concentration detected from the specimen according to the present invention at the C value of 0.25 g/ml was 0.1 ppm or less that exceeded a detection limit so that it was impossible to obtain a correct concentration (attached amount).

Thus, in order to obtain the cobalt concentration value of the steel cord specimen according to the present invention, the inventor of the present invention set the C value to be $0.5<C<2.5$ by concentrating and dissolving the specimen at a ratio 2 to 10 times higher than the conventional case and then performed the analysis. In other words, the cobalt concentration in the plating layer of the steel cord according to the present invention is in the range of infinitesimal amount which can be detected only through a special analysis beyond a conventional analysis, as described above.

Table 1 below shows results of ICP-AES analysis for respective top-surface cobalt concentrations of plating layers of steel cord specimens.

TABLE 1

| Items | Comp. Example 1 | Comp. Example 2 | Example 1 | Example 2 | Example 3 | Comp. Example. 3 | Remarks |
|---|---|---|---|---|---|---|---|
| Cobalt concentration within 4 nm top-surface of plating layer (ppm) | 0 | 0.0001 | 0.001 | 0.01 | 0.1 | 1.0 | |
| ICP (C = 0.25 g/ml) | 0.00 | 0.00 | 0.01 | 0.01 | 0.12 | 0.50 | Unit: ppm |
| ICP (C = 0.5 g/ml) | 0.00 | 0.00 | 0.01 | 0.18 | 0.30 | 1.10 | Unit: ppm |
| ICP (C = 1.25 g/ml) | 0.00 | 0.02 | 0.13 | 0.41 | 0.72 | 2.10 | Unit: ppm |

In table 1 above, when the ratio of a conventional test material and the amount of an acidic solution is 0.25 gl/ml (C=0.25 g/mm), in the case of Comparative Example 2, and Examples 1 and 2,in which the concentration within the 4 nm top-surface of the plating layer steel cord was 0.01 ppm or less, it was impossible to obtain correct detected values since all the values obtained by analyzing the specimens were equal to or lower than the detection limit. However, in the pre-treatment process of dissolving the specimens in acid for the purpose of wet analysis, analyzing solutions were prepared by dissolving the specimens to be highly concentrated such that the C values became 0.5 and 1.25, respectively, and then the solutions were analyzed using ICP-AES, which enabled the analysis on the specimens of Comparative Example 2 and Examples 1 and 2.

Meanwhile, the cobalt concentration of the specimens of the examples according to the present invention was not detected using conventional dry analysis equipment such as EDX, AES, ESCA. It was possible to analyze the cobalt concentration of the specimens of the examples according to the present invention in an XAS (X-ray Absorption Spectroscopy) that uses a synchrotron radiation accelerator as an analysis energy source and analyzes only a component of a specific atom within a 5 nm top-surface. Table 2 below shows results of top-surface cobalt concentration analysis of plating layers of the steel cord specimens performed using the dry analysis equipment and XAS analysis equipment.

TABLE 2

| Items | Comp. Example 1 | Comp. Example 2 | Example 1 | Example 2 | Example 3 | Comp. Example 3 | Remarks |
|---|---|---|---|---|---|---|---|
| Cobalt concentration within 4 nm top-surface of plating layer (ppm) | 0 | 0.0001 | 0.001 | 0.01 | 0.1 | 1.0 | |
| EDS | 0.00 | 0.00 | 0.01 | 0.01 | 0.01 | 0.01 | Unit: atomic % |
| AES | 0.00 | 0.00 | 0.01 | 0.02 | 0.02 | 0.02 | Unit: atomic % |
| XAS | 0.00 | 0.01 | 0.002 | 0.012 | 0.090 | 0.200 | Unit: % |

As in Table 2, in the dry analysis equipment, EDS and AES, no cobalt component was detected in all the specimens. In the case of XAS, analysis on Examples 1 to 3 and Comparative Example 3 was enabled. However, in the case of Comparative Example 2, it was impossible to obtain a detected value since the concentration was equal to or less than the detection limit value.

Through the analysis results of Tables 1 and 2, the cobalt concentration range of the plating layer of the steel cord claimed in the present invention is an infinitesimal concentration range which cannot be analyzed using conventional analysis equipment or analysis methods. Due to this, the cobalt concentration range is a region which has not drawn attention in the existing technical field from the start or has been excluded as being considered ineffective in the aging adhesive strength improvement by the addition of cobalt.

Meanwhile, Table 3 below shows results of initial and hygrothermal aging adhesive strength tests. The initial adhesive strength test was performed for 15 minutes at 140° C. according to ASTM D-2229, and the aging adhesive strength test was performed as the hygrothermal aging adhesive strength test, in which the specimens were stored for 7 days at 105° C.×100% RH.

TABLE 3

| Items | Comp. Example 1 | Comp. Example 2 | Example 1 | Example 2 | Example 3 | Comp. Example 3 |
|---|---|---|---|---|---|---|
| Cobalt concentration within top-surface 4 nm of plating layer (ppm) | 0 | 0.0001 | 0.001 | 0.01 | 0.1 | 1.0 |
| Number of times of snapping of drawn wire (times/ton) | 2.1 | 2.1 | 2 | 2.2 | 4.5 | 23.9 |
| Initial relative adhesive strength (%) | 100 | 100 | 101 | 100 | 98 | 93 |
| hygrothermal aging relative adhesive strength | 100 | 100 | 115 | 120 | 114 | 95 |

In Table 3 above, the initial and hygrothermal aging adhesive strengths refer to relative adhesive strengths when the measurement values of Comparative Example 1 are considered 100.

From Table 3, it can be seen that since the specimens of Examples 1 to 3 of the present invention exhibit initial adhesive strengths which are substantially the same as that of Comparative Example 1, which was not coated with the cobalt compound, and Comparative Example 2 in which the concentration of the cobalt compound was 0.0001 ppm, the cobalt compound does not contribute greatly to the improvement of the initial adhesive strength.

However, in the hygrothermal aging adhesive strength, it can be seen that the specimens of the examples of the present invention exhibit superior adhesive strengths as compared to the specimens of the comparative examples. Meanwhile, it can be seen that Comparative Example 3, in which the cobalt concentration is high as compared to the specimens of the examples of the present invention, exhibits a considerably high snapping rate of drawn wire as compared to the specimens of the examples of the present invention.

From the measurement results of Table 3 above, it can be seen that the cobalt existing in the infinitesimal amount range in a plating layer of a steel cord contributes to the aging adhesion improvement of the steel cord. It can also be seen that the aging adhesion becomes poor when the content of cobalt is less than or exceeds the concentration range of cobalt defined in the present invention.

The invention claimed is:

1. A steel cord for rubber reinforcement comprising one or more brass-plated steel wires, wherein cobalt is alloyed with the brass plating layer by a process of wet drawing of the brass-plated steel wire and is present in an amount of about 0.001 ppm to 0.1 ppm within a 4 nm top-surface depth from the surface of the plating layer of the brass-plated steel wire.

2. The steel cord of claim 1, wherein two or more brass-plated steel wires are stranded with each other.

3. A method of manufacturing a steel cord for rubber reinforcement, the method comprising:

providing a brass-plated steel wire;

mixing a cobalt compound in a wet lubricant filled in a wet drawing bath provided with a plurality of drawing dies between one pair of multi-stage drawing cones such that the concentration of the cobalt compound becomes 0.1 ppm to 100 ppm; and passing the brass-plated steel wire through the drawing cones and the drawing dies and subjecting to multi-stage drawing, wherein cobalt attached to the surface of the brass-plated steel wire is alloyed with the brass plating layer while passing through the drawing cones and the drawing dies and subjected to multi-stage drawing in the wet drawing bath such that cobalt is present in an amount of about 0.001 ppm to 0.1 ppm within a 4 nm top-surface depth from the surface of the plating layer of the brass-plated steel wire.

4. The method of claim 3, wherein the cobalt compound is cobalt boroacylate, cobalt naphthenate, cobalt stearate, cobalt neodecanoate, cobalt borocarboxylate, cobalt acetyl acetate, or cobalt abietate.

5. The method of claim 3, wherein the cobalt is present in the brass plating layer only as a ternary alloy of Cu—Zn—Co.

6. The steel cord of claim 1, wherein the cobalt is present in the brass plating layer only as a ternary alloy of Cu—Zn—Co.

* * * * *